US008787817B2

(12) United States Patent
Kikushima et al.

(10) Patent No.: US 8,787,817 B2
(45) Date of Patent: Jul. 22, 2014

(54) FIXING DEVICE AND IMAGE FORMING APPARATUS

(75) Inventors: Yuuki Kikushima, Ibaraki (JP); Sho Sawahata, Ibaraki (JP); Genichiro Kawamichi, Ibaraki (JP); Ken Onodera, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 415 days.

(21) Appl. No.: 13/064,103

(22) Filed: Mar. 7, 2011

(65) Prior Publication Data

US 2011/0222890 A1 Sep. 15, 2011

(30) Foreign Application Priority Data

Mar. 15, 2010 (JP) ..... 2010-058414
Sep. 27, 2010 (JP) ..... 2010-215704

(51) Int. Cl.
*G03G 15/00* (2006.01)
*G03G 15/20* (2006.01)
*G03G 21/20* (2006.01)

(52) U.S. Cl.
USPC ..... 399/406; 399/68; 399/69; 399/92; 399/94

(58) Field of Classification Search
USPC ..... 399/68, 69, 92, 94, 335, 337, 400, 405, 399/406
See application file for complete search history.

(56) References Cited

U.S. PATENT DOCUMENTS

| | | | | |
|---|---|---|---|---|
| 5,179,417 | A | | 1/1993 | Sugaya et al. |
| 5,495,324 | A | | 2/1996 | Kopp |
| 5,787,321 | A | * | 7/1998 | Nishikawa et al. ..... 399/69 |
| 5,842,098 | A | | 11/1998 | Ueno et al. |

FOREIGN PATENT DOCUMENTS

| | | | | |
|---|---|---|---|---|
| JP | 57-066461 | A | | 4/1982 |
| JP | 04321062 | A | | 11/1992 |
| JP | 07044043 | A | | 2/1995 |
| JP | 10123864 | A | | 5/1998 |
| JP | 2000238374 | A | | 9/2000 |
| JP | 2003208049 | A | | 7/2003 |
| JP | 2005099552 | A | | 4/2005 |
| JP | 2006215361 | A | | 8/2006 |
| JP | 2006215361 | A | * | 8/2006 |
| JP | 2006267769 | A | | 10/2006 |
| JP | 2007183353 | A | | 7/2007 |
| JP | 2007-328161 | A | | 12/2007 |
| JP | 4380232 | B | | 10/2009 |

OTHER PUBLICATIONS

Abstract of JP 2005-001303 published on Jan. 6, 2005.
Japanese Notice of rejection dated Feb. 18, 2014 for corresponding Japanese Application No. 2010-215704.

* cited by examiner

*Primary Examiner* — Joseph S Wong
(74) *Attorney, Agent, or Firm* — Harness, Dickey & Pierce, P.L.C.

(57) ABSTRACT

A fixing device includes a conveying unit configured to convey a recording medium; a conveyance stopping unit configured to stop conveyance of the recording medium; a heating unit having a heating plane and configured to heat a part of the recording medium, which part is laid over the heating plane; and a cooling unit configured to cool the part of the recording medium, whose conveyance has been stopped, by applying cooling air to the part of the recording medium from above.

20 Claims, 10 Drawing Sheets

FIG.10

| PAPER TYPE | COOLING TEMPERATURE | WIND SPEED |
|---|---|---|
| $S_1$ PROPER MOISTURE CONTENT($W_1$) | $C_1$ | $V_1$ |
| ⋮ | ⋮ | ⋮ |
| $S_N$ PROPER MOISTURE CONTENT($W_N$) | $C_N$ | $V_N$ |

FIXING DEVICE AND IMAGE FORMING APPARATUS

CROSS-REFERENCE TO RELATED APPLICATIONS

This patent application is based upon and claims the benefit of priority of Japanese Patent Application No. 2010-058414 filed on Mar. 15, 2010 and Japanese Patent Application No. 2010-215704 filed on Sep. 27, 2010 the entire contents of which are incorporated herein by reference.

BACKGROUND OF THE INVENTION

1. Field of the Invention

The present invention is generally directed to a fixing device for fixing a toner image to a recording medium, and also directed to an image forming apparatus.

2. Description of the Related Art

Among fixing devices used in image forming apparatuses, one known type of such applies heat and pressure to paper, on the surface of which an unfixed toner image is carried, by holding, the paper between a heating roller and a pressure roller while conveying the paper, to thereby fix the toner image onto the paper.

At a stage previous to the pressure roller, a heating plate having multiple heaters inside is provided, and the heating plate applies heat to the paper. This application of heat by the heating plate is ancillary to the application of heat and pressure by the heating roller and the pressure roller to the paper which is held between these rollers and conveyed. In general, image forming apparatuses that perform high speed printing or support long continuous paper (web) require increased heat capacity for fixing toner images. Applying heat to paper supplementarily by the heating plate facilitates reducing an increase in the fixing temperature.

Heating paper by the heating plate allows the temperature of the heating roller to be reduced; however, if paper is laid on the heating plate for more than a fixed period of time when a printing job is stopped, the paper is heated more than necessary, which sometimes results in paper contraction and/or damage.

In order to solve such a problem, a technology has been proposed that detaches the paper from the heating plate using a pin, a wire or the like (see Patent Document 1, for example).

In another known technology, when conveyance of printing paper is stopped in a second printer used for tandem duplex printing, air is sent from the printing paper side in order to prevent an increase in temperature of an area between detached paper and the heating plate, prevent the paper from being deformed by heat and reduce quality loss in printing of the back side of the paper (see Patent Document 2, for example).

[Patent Document 1] Japanese Laid-open Patent Application Publication No. H10-123864

[Patent Document 2] Japanese Laid-open Patent Application Publication No. 2006-215361

However, simply detaching the paper from the heating plate according to the technology of Patent Document 1 is not sufficient and paper damage/contraction is sometimes caused since the paper is heated by radiant heat from the heating plate. Furthermore, even when a mechanism for sending air from the printing paper side is provided, as in the case of Patent Document 2, paper damage/contraction may still be caused.

SUMMARY OF THE INVENTION

Accordingly, embodiments of the present invention may provide a novel and useful fixing device and image forming apparatus solving one or more of the problems discussed above.

In view of the above-described problems, the embodiments of the present invention may provide a fixing device and an image forming apparatus capable of properly preventing paper damage/contraction even when paper stops on the heating plate for more than a fixed period of time.

One aspect of the present invention may be to provide a fixing device including a conveying unit configured to convey a recording medium; a conveyance stopping unit configured to stop conveyance of the recording medium; a heating unit having a heating plane and configured to heat a part of the recording medium, which part is laid over the heating plane; and a cooling unit configured to cool down the part of the recording medium, whose conveyance has been stopped, by applying cooling air to the part of the recording medium from above.

Another aspect of the present invention is an image forming apparatus including a fixing device that includes a conveying unit configured to convey a recording medium, a conveyance stopping unit configured to stop conveyance of the recording medium, a heating unit having a heating plane and configured to heat a part of the recording medium laid over the heating plane, and a cooling unit configured to cool down the part of the recording medium, whose conveyance has been stopped, by applying cooling air to the part of the recording medium from above; and an image forming unit configured to form an image on the recording medium.

Additional objects and advantages of the embodiments will be set forth in part in the description which follows, and in part may be obvious from the description, or may be learned by practice of the invention. The object and advantages of the invention may be realized and attained by means of the elements and combinations particularly pointed out in the appended claims.

It is to be understood that both the foregoing general description and the following detailed description are exemplary and explanatory only and are not restrictive of the invention as claimed.

BRIEF DESCRIPTION OF THE DRAWINGS

FIG. 10 shows one example of correspondence information according to an eighth embodiment of the present invention.

DETAILED DESCRIPTION OF THE PREFERRED EMBODIMENTS

Descriptions of terms are given prior to describing embodiments of the present invention. The term "image forming apparatus" denotes, for example, a printer, a facsimile machine, a copier, a plotter or a multi-function peripheral serving multiple functions of the aforementioned apparatuses. The term "recording medium" denotes a medium made of, for example, paper, textile threads, fibers, leather, metal, plastic, glass, wood or ceramic. The following description is given using continuous paper (web) as the recording media. The term "image formation" means applying an image, such as a letter, a diagram and a pattern, to a recording medium, or simply causing a liquid droplet (ink) to land on a recording medium. In addition, the following description uses a plate-like heating plate and a paper conveyance tractor as a heating system and a conveying system, respectively.

First Embodiment

Overall Configuration

Figure 1:
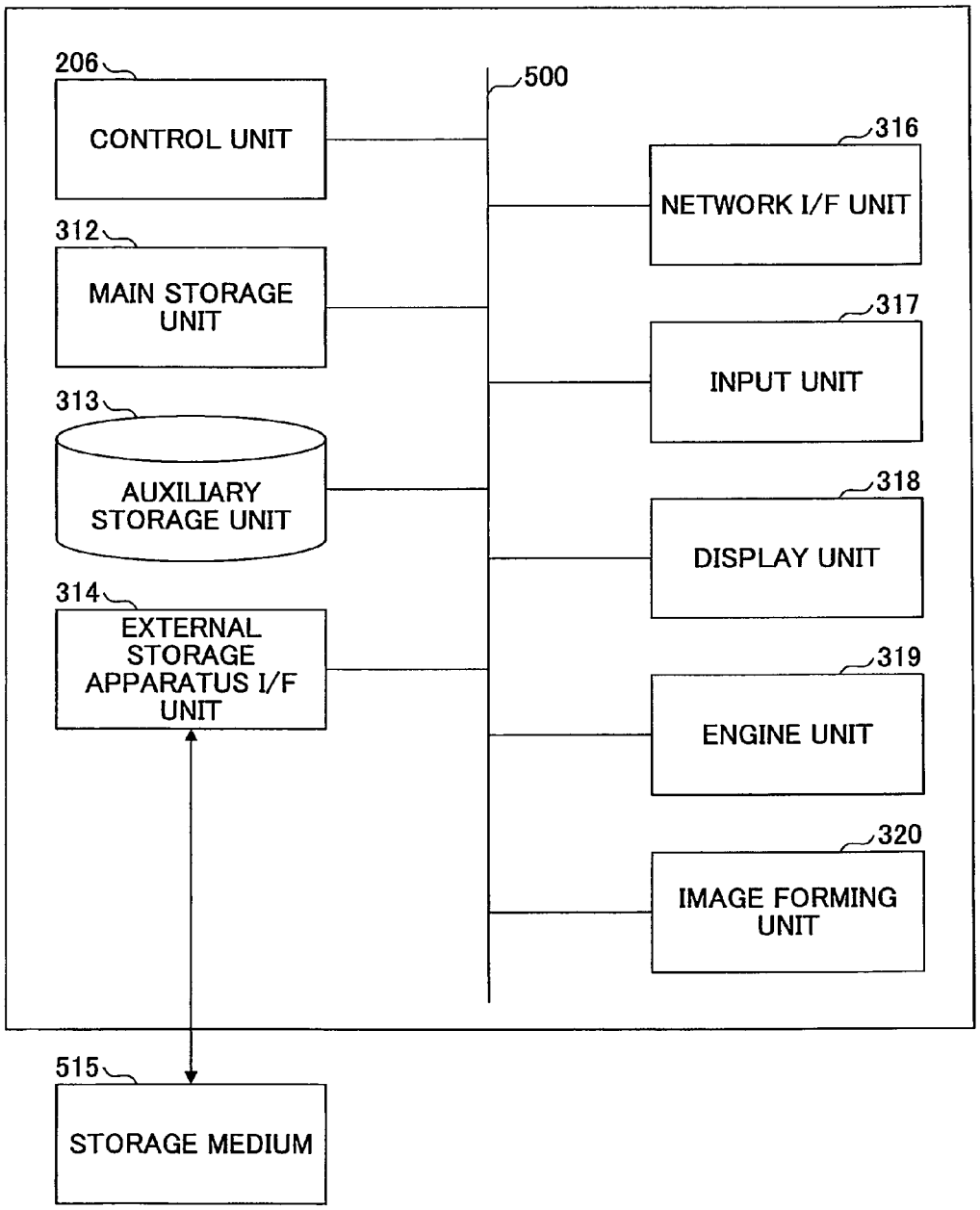
FIG. 1 shows a functional example of an image forming apparatus according to a first embodiment of the present invention (part 1)

FIG. 1 shows a functional example of an image forming apparatus 1 according to the present embodiment. As illustrated in FIG. 1, the image forming apparatus 1 of the present embodiment includes a control unit 206, a main storage unit 312, an auxiliary storage unit 313, an external storage apparatus I/F unit 314, a network I/F unit 316, an input unit 317, a display unit 318, an engine unit 319 and an image forming unit 320. These components are connected to each other by a bus 500.

The control unit 206 is a CPU for controlling each device and performing data calculation and processes in a computer. In addition, the control unit 206 functions as a processing device for running a program stored in the main storage unit 312. Specifically, the control unit 206 receives data from an input device or a storage device, calculates and processes the data, and then outputs the result to an output device or a storage device.

The main storage unit 312 is a ROM (Read Only Memory), a RAM (Random Access Memory) or the like, and is a storage device for storing or temporarily storing data and programs, such as an operating system (OS) and application software, to be run by the control unit 206.

The auxiliary storage unit 313 is, for example, a HDD (Hard Disk Drive), and is a storage device for storing data related to application software. The external storage apparatus I/F unit 314 is an interface between the image forming apparatus 1 and a storage medium 515 (for example, a flash memory) connected via a data transmission line, such as a USB (Universal Serial Bus).

In addition, a predetermined program may be stored in the storage medium 515, and installed in the image forming apparatus 1 via the external storage apparatus I/F unit 314. Herewith, the installed program becomes ready to be executed by the image forming apparatus 1.

The network I/F unit 316 is an interface between the image forming apparatus 1 and peripherals having a communication function and connected via a network, such as a LAN (Local Area Network) and a WAN (Wide Area Network) equipped with wired and/or wireless data transmission paths.

The input unit 317 and the display unit 318 include key switches (hardware keys) and a LCD (Liquid Crystal Display) with a touch panel function (including Graphical User Interface (GUI)/softkeys), and are display and/or input devices for functioning as UIs (User Interfaces) to allow users to use functions of the image forming apparatus 1.

The engine unit 319 is provided for driving respective motors and mechanical parts, such as a plotter and a scanner, which perform actual processes pertaining to image formation. The engine unit 319 drives the image forming unit 320 to thereby print paper.

Configuration Diagram of Image Forming Apparatus

Figure 2:
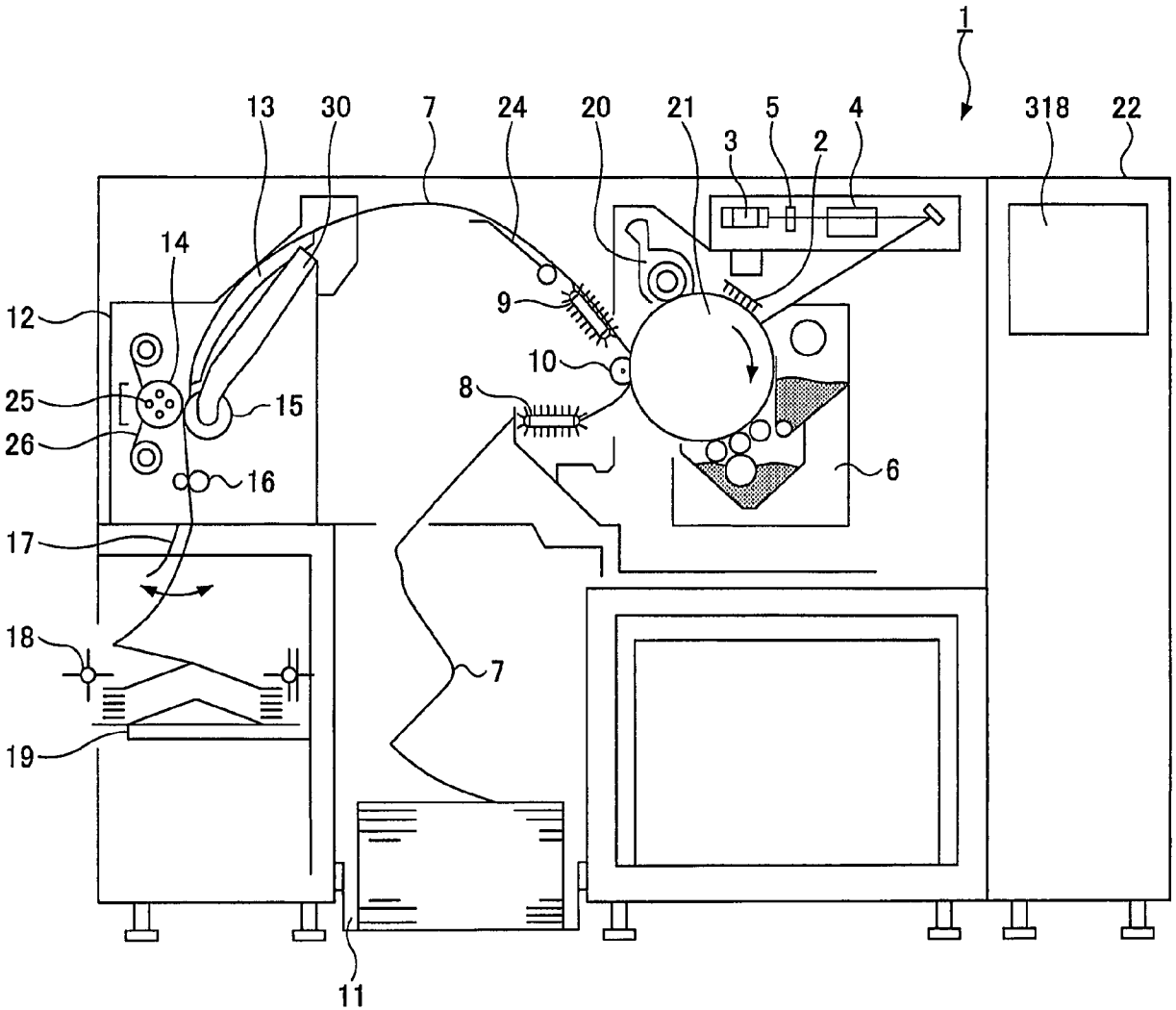
FIG. 2 shows the functional example of the image forming apparatus according to the first embodiment of the present invention (part 2)

FIG. 2 shows a functional example of the image forming apparatus 1 according to the present embodiment. A photosensitive drum 21 rotates in the direction as indicated by the arrow based on a printing operation start signal transmitted from a controller 22. The photosensitive drum 21 rotates at a speed corresponding to a printing speed of the image forming apparatus 1 and keeps rotating until the printing operation is completed. When the photosensitive drum 21 starts rotating, high voltage is applied to a corona charger 2, and thereby the surface of the photosensitive drum 21 is uniformly charged, for example, positively.

A rotating polygon mirror 3 starts rotating immediately when the image forming apparatus 1 is powered on, and is kept rotating at a constant speed with high accuracy while the power is on. Light emitted from a light source 4, such as a semiconductor laser, is reflected by the rotating polygon mirror 3 and then incident via an fθ lens 5 to scan over the photosensitive drum 21. When text data or graphic data that have been converted into dot image data are transmitted to the image forming apparatus 1 from the controller 22 as on-off signals of a laser beam, some parts of the surface of the photosensitive drum 21 are irradiated with the laser beam but other parts are not, and herewith a so-called electrostatic latent image is formed on the surface of the photosensitive drum 21.

When the region of the photosensitive drum 21 holding the electrostatic latent image reaches a position opposite to a developing device 6, toner is supplied to the electrostatic latent image. The toner with, for example, positive charge is attracted by static electricity to parts on the photosensitive drum 21 on which electrical charges have been neutralized by the aforementioned irradiation of the laser beam, and thus a toner image is formed on the photosensitive drum 21.

Continuous paper (web) 7 housed in a paper hopper 11 is conveyed by paper conveyance tractors 8 and 9 toward a place between the photosensitive drum 21 and a transfer unit 10 in synchronization with timing at which the toner image formed on the photosensitive drum 21 reaches a transfer position. The transfer unit 10 applies a charge having a polarity opposite to that of the toner image to the back surface of the paper 7, and thereby the toner image formed on the photosensitive drum 21 is attracted onto the paper 7.

Then, the paper 7 is conveyed to a fixing device 12 via the paper conveyance tractor 8, the transfer unit 10, the paper conveyance tractor 9 and a buffer plate 24. After reaching the fixing device 12, the paper 7 is heated by a heating plate 13 having multiple heaters inside. Subsequently, when the paper 7 is conveyed while being held between a pair of fixing rollers made up of a heating roller 14 having multiple heater lamps 25 inside and a pressure roller 15, heat and pressure are applied to the paper 7 by a nip portion formed by the paired fixing rollers (i.e. a portion at which the heating roller 14 abuts the pressure roller 15). Herewith, the toner image is melted and fixed to the paper 7.

The paper 7 sent out by the heating roller 14 and the pressure roller 15 is ejected onto a stack table 19 by paper sending rollers 16 while being alternately folded along perforations by swing operation of a swing fin 17. In addition, the paper 7 is stacked on the stack table 19 while being accurately folded by rotating paddles 18. A region of the photosensitive drum 21 having passed through the transfer position is cleaned by a cleaning device 20 to be ready for the next printing operation.

The buffer plate 24 is used for absorbing the slack or tension caused in the paper 7 when there is a difference in a paper conveyance speed between the paper conveyance tractor 9 and the fixing rollers (i.e., the heating roller 14 and the pressure roller 15). The display unit 318 displays information based on the status of the image forming apparatus 1 during the printing operation. Reference numeral 26 denotes a web member provided in such a manner as to come in contact with the heating roller 14 and be wound up from the surface of the heating roller 14. The web member 26 is used for coating a release agent and a lubricant on the surface of the heating roller 14.

As described above, the fixing device 12 according to the present embodiment includes the heating plate 13, the heating roller 14, the pressure roller 15 and the like.

Configuration of Heating Plate 13

Figure 3:
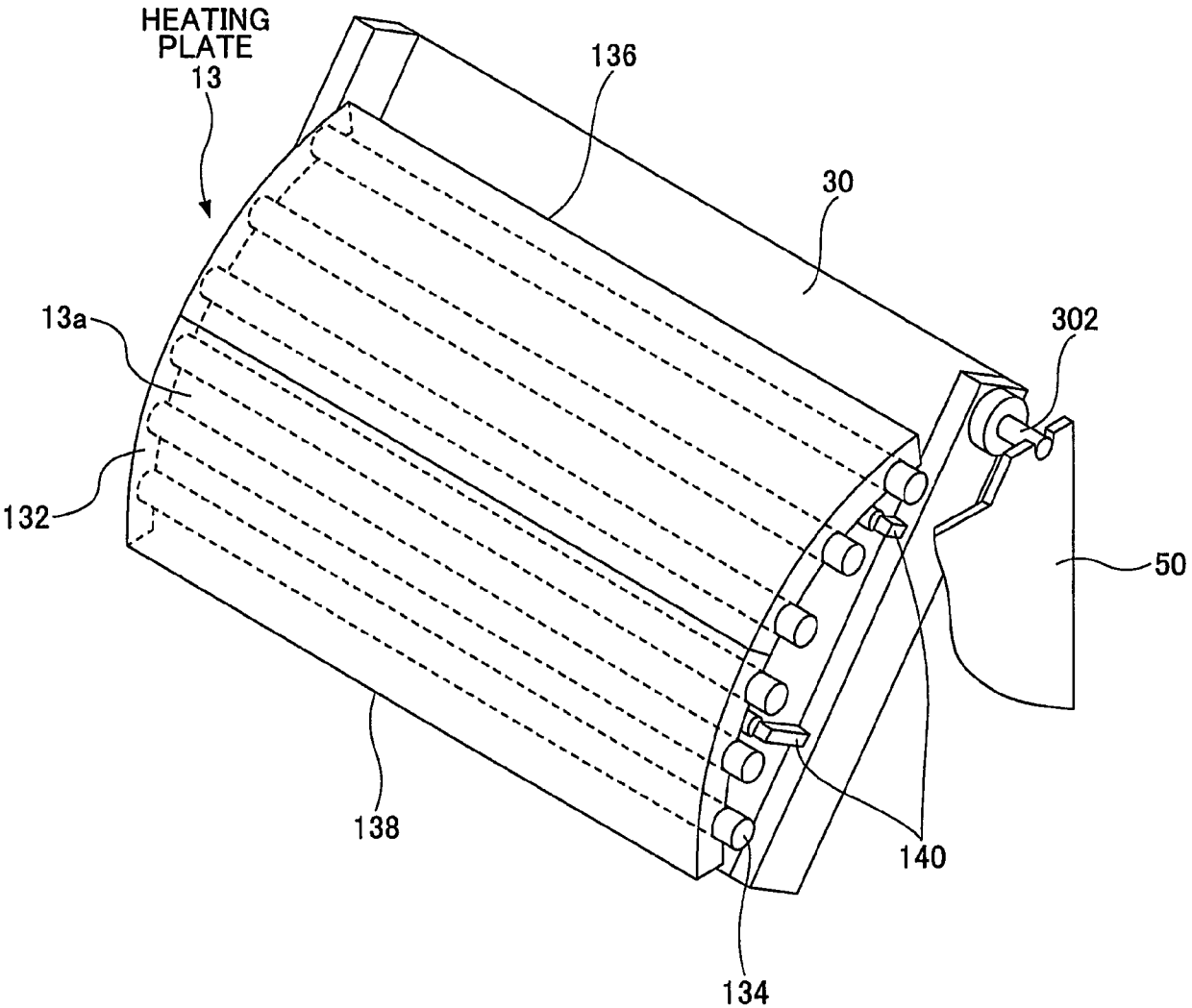
FIG. 3 shows a heating system according to the first embodiment of the present invention.

Next is described the configuration of the heating plate 13. FIG. 3 is a perspective view of the heating plate 13 and a heating plate frame 30, to which the heating plate 13 is attached. The heating plate 13 includes a metal plate 132 made, for example, of aluminum and multiple heaters 134 (six in the case of FIG. 3). In this case, the respective heaters 134 have a circular cylindrical shape and are provided to run through the metal plate 132 in the width direction of the paper 7 conveyed over the metal plate 132.

The heating plate 13 is divided into an upper part 136 and a lower part 138. The settings of the surface temperatures for the upper part 136 and the lower part 138 can be individually controlled by the control unit 206.

The heating plate 13 is fixed to the heating plate frame 30 by supporting members 140. In the case shown in FIG. 3, the heating plate frame 30 has a shape of a square bracket in cross section. The heating plate frame 30 is fixed to a frame 50 of the fixing device 12 by supporting members 302.

In the following explanation, a heating plane 13*a* of the heating plate 13 is one surface of the heating plate 13 opposing the paper 7 passing over the heating plate 13 (see FIG. 4). That is, the heating plate 13 heats a part of the paper 7 laid over the heating plane 13*a* (i.e., a part opposing the heating plane 13*a*). In the following explanation, the part of the paper 7 opposing the heating plane 13*a* is referred to as an "opposing part 7*a*". The opposing part 7*a* is indicated by the thick line in FIG. 5 to be described below.

Cooling System

In the fixing device 12 according to the present embodiment, if the paper 7 is stopped, for example, because a printing job is stopped, the opposing part 7*a* of the paper 7 having been stopped is cooled down by a cooling system. Various cooling systems may be adoptable, and one example of such is a system for generating cooling air and sending the cooling air to the opposing part 7*a* of the paper 7 from above to thereby cool the paper 7 having been stopped.

As another example of the adoptable cooling systems, ambient air (about 20 to 28° C.) which is air outside the image forming apparatus 1 equipped with the fixing device 12 is taken in and used as cooling air to cool the paper 7 having been stopped. This is effective since, in general, the temperature inside of the room where the image forming apparatus 1 is installed is comparatively lower than the temperature of air near the heating plate 13 of the fixing device 12. Therefore, air can be used to cool the paper 7 by the cooling system of the present invention as long as the air has a lower temperature than that of air near the heating plate 13; yet, ambient air is especially preferable. In the following, the description is given of the case in which ambient air is taken in and then blown onto the opposing part 7*a* of the paper 7 having been stopped.

Figure 4:
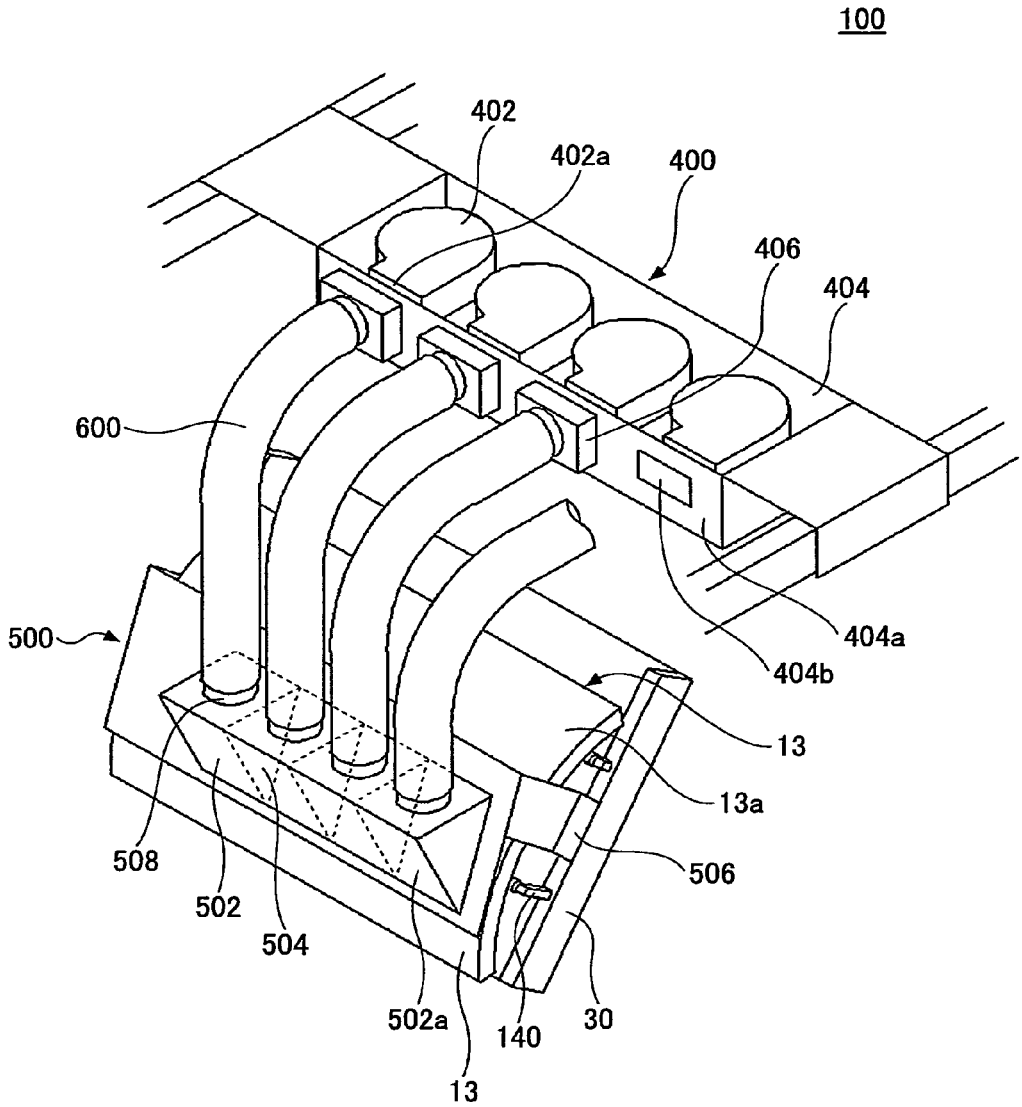
FIG. 4 is a perspective view of a cooling system according to the first embodiment of the present invention.
Figure 5:
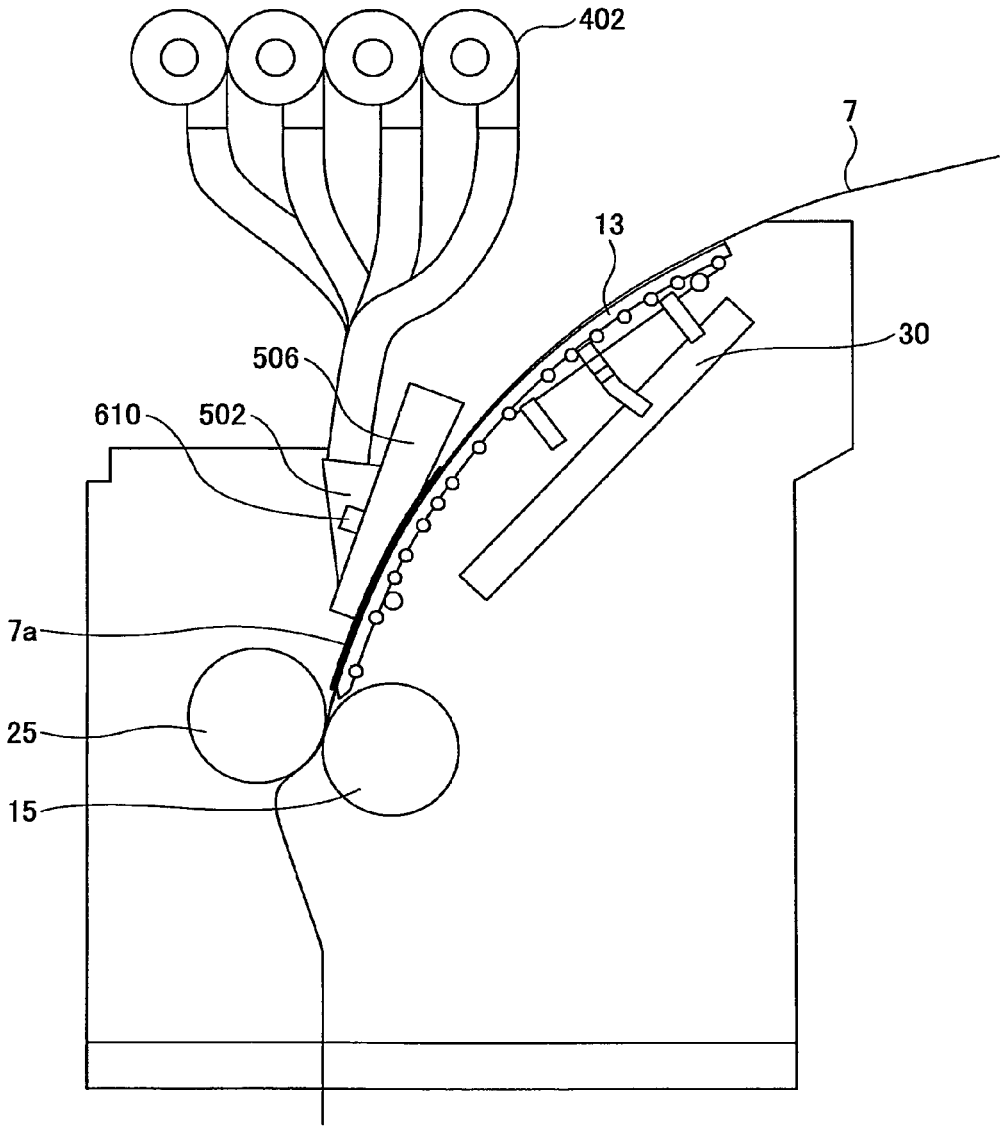
FIG. 5 is a side view of the cooling system according to the first embodiment of the present invention.

FIG. 4 is a perspective view of a cooling system 100, and FIG. 5 is a side view of the cooling system 100 attached inside the fixing device 12.

As shown in FIGS. 4 and 5, the cooling system 100 includes a blowing unit 400, a duct unit 500, and cooling air conveying units 600 connecting the blowing unit 400 and the duct unit 500.

The blowing unit 400 includes intake members 402, a housing member (holder) 404 and connecting members 406. In the example shown in FIGS. 4 and 5, multiple intake members 402 (four in the case of FIGS. 4 and 5) are provided. The intake members 402 are, for example, fans and are configured to take in ambient air and blow the taken-in air out from blowers 402*a*. The four intake members 402 are housed in the housing member 404. On a side surface 404*a* of the housing member 404, a number of holes 404*b* the same as the number of intake members 402 are provided. The connecting members 406 are attached to the respective holes 404*b*, and the cooling air conveying units 600 and the intake members 402 are connected via the connecting members 406. The cooling air conveying units 600 are configured to convey ambient air sent out of the intake members 402 to ambient air blowing members 502, and hoses can be used for the cooling air conveying units 600. Specifically, the cooling air conveying units 600 for sending ambient air are formed of accordion hoses so as to follow the duct unit 500 which moves with the heating plate frame 30. The same number of cooling air conveying units 600 and intake members 402 are provided.

The duct unit 500 includes the ambient air blowing members 502, partition plates 504 and a holder 506. The ambient air blowing members 502 are connected to the respective cooling air conveying units 600 by a base 508. The inside of the ambient air blowing member 502 is hollow and has a triangular prism shape. The ambient air blowing members 502 may take the form of, for example, ducts, and each has an ambient air injection outlet 502*a* for discharging ambient air blown out of the corresponding intake member 402 to the opposing part 7*a* of the paper 7.

The ambient air blowing members 502 cool the opposing part 7*a* of the paper 7 having been stopped by applying, as cooling air, the ambient air blown out of the intake members 402 to the opposing part 7*a* from the ambient air injection outlets 502*a*. The same number of cooling air conveying units 600, bases 508 and ambient air blowing members 502 as the number of intake members 402 are provided (four in this case).

The ambient air blowing members 502 are fixed to the holder 506, which is fixed to the heating plate frame 30. The heating plate 13 is also fixed to the heating plate frame 30 by supporting members 140. The duct unit 500 is disposed close to the heating plate 13 in such a manner as to form a predetermined gap (a gap which allows conveyance of the paper 7) between the heating plane 13*a* of the heating plate 13 and the ambient air injection outlets 502*a* of the ambient air blowing members 502, from which ambient air is discharged.

Figure 8:
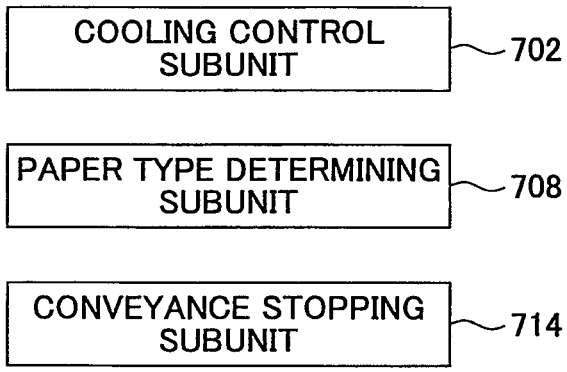
FIG. 8 shows a functional example of a control unit according to a seventh embodiment of the present invention.

A functional example of the control unit 206 is shown in FIG. 8. The conveyance of the paper 7 is stopped by a conveyance stopping subunit 714 of the control unit 206. When the conveyance of the paper 7 is stopped or a predetermined time period has elapsed after the conveyance stop, a cooling control subunit 702 of the control unit 206 starts the cooling system 100 via the engine unit 319, and thereby cools the paper 7 stopped and laid over the heating plate 13. In the fixing device 12 according to the first embodiment of the present invention, as described above, when the conveyance of the paper 7 is stopped, the opposing part 7*a* of the paper 7 is cooled by the cooling system 100. Herewith, it is possible to prevent the opposing part 7*a* of the paper 7 from being damaged by heat from the heating plate 13. In particular, in the case where the paper 7 is adhesive press-fitted paper, there is conventionally a problem that moisture in the adhesive press-fitted paper is evaporated by heat from the heating plate 13, which in turn leads to a decrease in the adhesive strength of the sticking agent. In this case also, the cooling system 100 according to the present embodiment can be used to cool the opposing part 7*a* of the paper 7 (adhesive press-fitted paper), and it is thus possible to prevent a decrease in the adhesive strength. Note that the adhesive press-fitted paper is paper formed by including a sticking agent in advance, and an example of this is a double postcard.

In addition, in the fixing device 12 according to the present embodiment, cooling air is applied to the opposing part 7*a* of the paper 7 from above. Herewith, the entire paper 7 is uniformly cooled, which provides excellent cooling efficiency.

Second Embodiment

According to the second embodiment of the present invention, multiple intake members 402 are provided (four in the case shown in FIG. 4) and aligned in the width direction of the paper 7 being conveyed. With this configuration, the numbers of intake members 402 and ambient air blowing members 502 corresponding to the width of the paper 7 are used to blow ambient air onto the paper 7 having been stopped.

Here, the number of intake members 402 corresponding to the width of the paper 7 is determined in such a manner that, in the width direction of the paper 7, the extent of the total length of ambient air injection outlets 502*a* to be used becomes closest to the width of the paper 7. This determination of the number of intake members 402 is made by the control unit 206. The user may measure the width of the paper 7 and input the measurement using the input unit 317 to transmit the measurement to the control unit 206. Alternatively, a not-shown paper width sensor may be used to detect the width of the paper 7, which is then transmitted to the control unit 206.

The reason for using only the number of intake members 402 corresponding to the width of the paper 7 is to decrease wasted consumption of power. In the case when the width of the paper 7 is small, cooling air is also blown directly onto a part of the heating plate 13 where no paper 7 is present, and this has the effect of decreasing the temperature of the heating plate 13 while the heating plate 13 is controlled to be maintained at a setting temperature. These opposing actions result in wasted power consumption. Therefore, by changing the number of intake members 402 to be used according to the width of the paper 7, it is possible to decrease the consumption of power.

Third Embodiment

According to the third embodiment of the present invention, partition plates are preferably provided between adjacent ambient air blowing members. For example, the partition plates 504 are provided between the adjacent ambient air blowing members 502 as shown in FIG. 4. The partition plates 504 are provided in order to individually separate the multiple ambient air blowing members 502. With the partition plates 504, it is possible to prevent ambient air out of the adjacent ambient air blowing members 502 from blowing into other ambient air blowing members 502.

Fourth Embodiment

According to the fourth embodiment of the present invention, the hoses of the cooling air conveying units 600 are preferably stretchable. Specifically, the cooling air conveying units 600 are formed of, for example, accordion hoses to thereby allow flexibility in the hose length. With this configuration, when the duct unit 500 moves according to the movement of the heating plate frame 30, it is possible to accommodate a change in the distance between the blowing unit 400 and the duct unit 500.

Fifth Embodiment

According to the fifth embodiment of the present invention, the control unit 206 starts (restarts) a printing job (image formation) of the image forming unit 320 after the printing job has been stopped. Then, the control unit 206 stops cooling provided by the cooling system 100 at the start of the printing job. If cooling of the paper 7 is continued after the start of the printing job, the temperature of the paper 7 does not reach a temperature necessary to cause a toner image to be melted and fixed on the paper 7 when the paper 7 is nipped by the heating roller 14 and the pressure roller 15. This results in poor fixation of the toner image. Therefore, by stopping the cooling process by the cooling system 100 at the start of the printing job, the paper 7 is conveyed over the heating plate 13 in a steady manner without being cooled too much.

Sixth Embodiment

The sixth embodiment of the present invention relates to a preferable cooling method by the cooling system 100. The following descriptions of "First Preferable Cooling Method", "Second Preferable Cooling Method" and "Third Preferable Cooling Method" take an example where adhesive press-fitted paper is used as the paper 7. In "First Preferable Cooling Method" and "Second Preferable Cooling Method", a distance L (not shown) between the opposing part 7*a* of the paper 7 and outlets from which cooling air of the cooling system 100 is discharged is 10 to 30 mm. The "outlets" here are parts from which cooling air is discharged, and in the case where the cooling system 100 of FIG. 4 is used, the outlets are the ambient air injection outlets 502*a*.

First Preferable Cooling Method

As the first preferable cooling method, experiments have shown that it is preferable to apply ambient air (cooling air) out of the ambient air blowing members 502 (see FIG. 4) to the paper 7 at a wind speed of 10 m/s, or substantially 10 m/s. In addition, the heating temperature of a heating system in this case is 95° C., or substantially 95° C. Here, "the heating temperature of a heating system" is referred to as the temperature of the heating plate 13. The toner on the paper 7 over the lower part 138 (see FIG. 3) of the heating plate 13 has temporarily been fixed since it has passed through the upper part 136 and received heat from the upper part 136. Accordingly, if the wind speed of the applied ambient air is 10 m/s, or substantially 10 m/s, neither scattering nor position misalignment of toner occurs, and there is no influence on the print quality.

Second Preferable Cooling Method

Figure 11A:
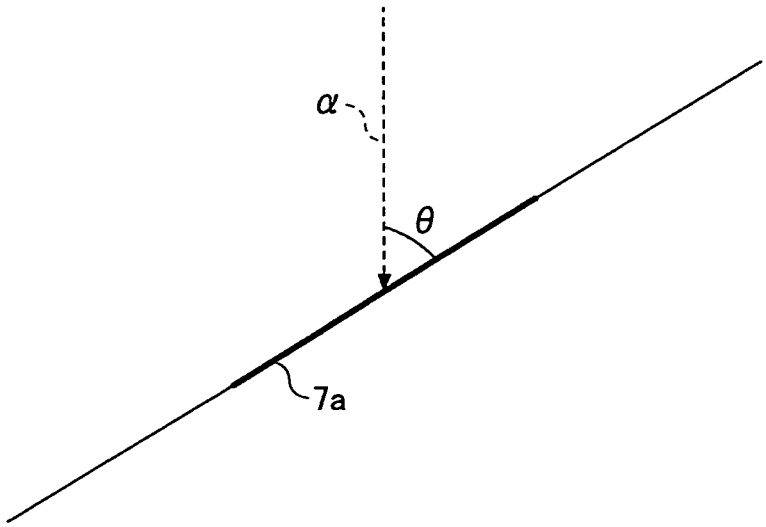
FIGS. 11A and 11B are another set of illustration diagrams showing the travel direction of cooling air according to the sixth embodiment of the present invention.
Figure 11B:
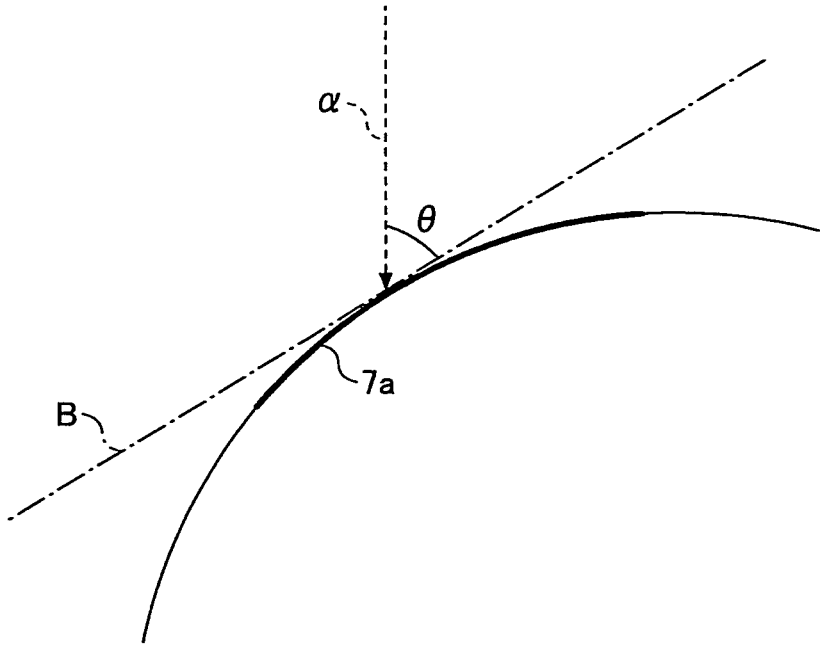

Next is described the second preferable cooling method. In the second preferable cooling method, the opposing part 7*a* is referred to as a "heated plane 7*a*" since it is a planar object to be heated. Experiments have shown that an angle between a travel direction a of the cooling air and the heated plane 7*a* is preferably 60° or more and 120° or less, as shown in FIGS. 11A and 11B, in the case where the wind speed of the cooling air is 10 m/s, or substantially 10 m/s. Also, the heating temperature of the heating system (heating plate 13) in this case is 95° C., or substantially 95° C. With this configuration, it is possible to cool the entire heated plane 7*a* efficiently while further preventing occurrence of scattering and position misalignment of toner, compared to the first preferable cooling method.

Description is given of the angle θ with reference to FIGS. 11A and 11B. The heated plane 7*a* may be planar as illustrated in FIG. 11A, or may be curved as illustrated in FIG. 11*b*. When the heated plane 7*a* is planar as in the case of FIG. 11A, the angle θ is an angle between the heated plane 7*a* and the travel direction α of the cooling air (indicated by the dotted line). When the heated plane 7*a* is curved as in the case of FIG. 11B, the angle θ is an angle between a tangent B (the dashed-dotted line) to the heated plane 7*a* and the travel direction a of the cooling air. The cooling system 100 applies the cooling air to the heated plane 7*a* in such a manner that the angle θ is 60° or more and 120° or less.

According to the second preferable cooling method, it is possible to cool the entire heated plane 7*a* efficiently while further preventing occurrence of scattering and position misalignment of toner, compared to the first preferable cooling method.

Third Preferable Cooling Method

Figure 7A:
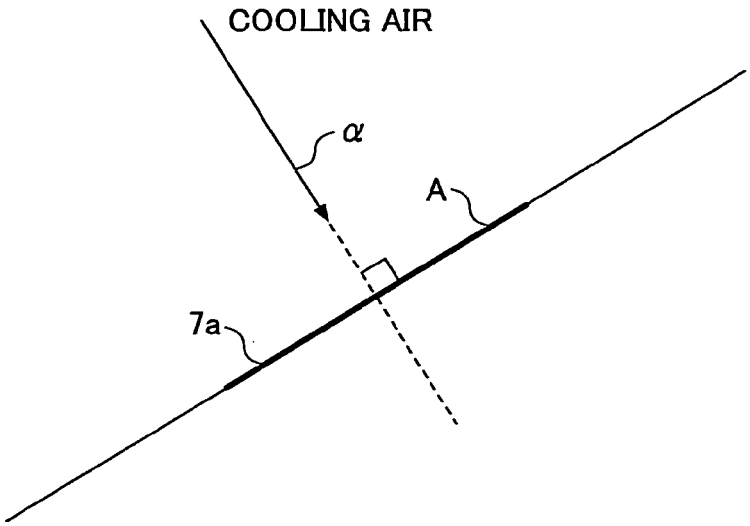
FIGS. 7A and 7B are a set of illustration diagrams showing a travel direction of cooling air according to a sixth embodiment of the present invention.
Figure 7B:
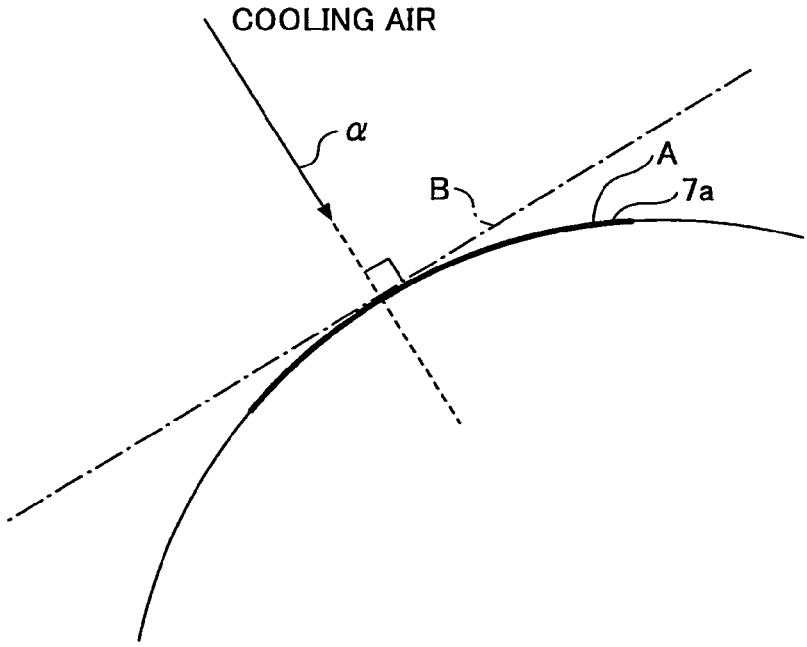

Next is described the third preferable cooling method. Experiments have shown that the travel direction α of the cooling air is preferably perpendicular, or substantially perpendicular, to the heated plane 7*a*. FIGS. 7A and 7B illustrate the third preferable cooling method. When the heated plane 7*a* is planar as in the case of FIG. 7A, the cooling system 100 applies the cooling air to the heated plane 7*a* in such a manner that the travel direction α of the cooling air is perpendicular, or substantially perpendicular, to the heated plane 7*a*. When the heated plane 7*a* is curved as in the case of FIG. 7B, the cooling system 100 applies the cooling air to the heated plane 7*a* in such a manner that the travel direction a of the cooling air is perpendicular, or substantially perpendicular, to the tangent B to the heated plane 7*a*.

According to the third preferable cooling method, it is possible to cool the entire heated plane 7*a* efficiently while further preventing occurrence of scattering and position misalignment of toner, compared to the first and second preferable cooling methods. In addition, according to the third preferable cooling method, scattering and position misalignment of toner do not occur even when the wind speed of the cooling air is more than 10 m/s.

Seventh Embodiment

Next is described the seventh embodiment of the present invention. The moisture content of the opposing part 7*a* of the paper 7 after the conveyance by the conveying system is stopped and the cooling process by the cooling system 100 takes place is referred to as "X1". On the other hand, the moisture content of the opposing part 7*a* of the paper 7 immediately before the conveyance is stopped is referred to as "X2". The cooling system 100 according to the seventh embodiment cools the opposing part 7*a* in such a manner that the moisture content X1 becomes equal or substantially equal to the moisture content X2. That is, the cooling system 100 cools the opposing part 7*a* of the paper 7 in such a manner that the moisture content X1 of the opposing part 7*a* after the cooling process becomes equal or substantially equal to the moisture content X2 of the opposing part 7*a* immediately before the conveyance is stopped.

In general, some types of paper lose their properties when the moisture content X1 is different from the moisture content X2 due to heat by the heating plate 13 and/or cooling by the cooling system 100. For example, in the case of adhesive press-fitted paper to be described below, the adhesive strength, which is the property of the adhesive press-fitted paper, may be lost when the moisture content X1 is different from the moisture content X2. Such paper whose property is lost when the moisture content X1 is different from the moisture content X2 is referred to as property paper S. Next is described an example of the cooling method of making the moisture content X1 be equal or substantially equal to the moisture content X2.

For example, in the case where it is known that only one type of property paper S is used for printing, a cooling parameter of the cooling system 100 is preliminarily set in such a manner that the moisture content X1 becomes equal or substantially equal to the moisture content X2 of the property paper S, and prestored in one of the main storage unit 312, the auxiliary storage unit 313 and the storage medium 515 (hereinafter, referred to as the "main storage unit 312 or the like" or "storage system").

Here, the term "cooling parameter" denotes a parameter related to cooling by the cooling system 100, and is at least one of the temperature (cooling temperature) and the wind speed of the cooling air. The cooling system 100 cools the opposing part 7*a* based on the prestored cooling parameter. The cooling control of the cooling system 100 is performed by the cooling control subunit 702 (see FIG. 8) of the control unit 206. The cooling control subunit 702 causes the cooling system 100 to perform the cooling process based on the cooling parameter stored in the main storage unit 312 or the like.

Figure 9:
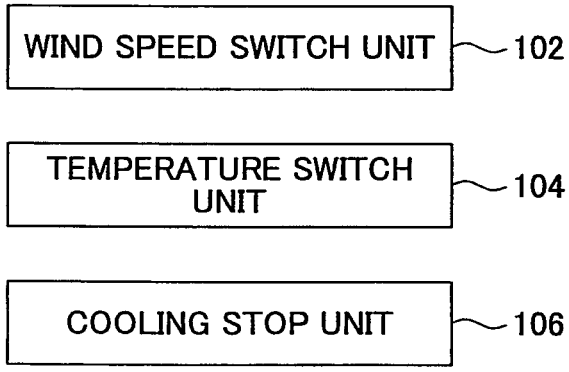
FIG. 9 shows a functional example of the cooling system according to the seventh embodiment of the present invention.

As shown in FIG. 9, the cooling system 100 preferably has at least one of a wind speed switch unit 102 and a temperature switch unit 104. The wind speed switch unit 102 is configured to change the wind speed of the cooling air of the cooling system 100 among multiple speed settings. The temperature switch unit 104 is configured to change the temperature of the cooling air of the cooling system 100 among multiple temperature settings.

In the case where the cooling control subunit 702 controls the cooling process by switching the wind speed of the cooling air of the cooling system 100, the wind speed switch unit 102 changes the wind speed. The wind speed switch unit 102 is provided inside each of the intake members 402 and changes, for example, the speed of blowing out, from the blower 402*a*, the ambient air taken in by the intake member 402.

Similarly, in the case where the cooling control subunit 702 controls the cooling process by switching the temperature of the cooling air of the cooling system 100, the temperature switch unit 104 changes the temperature of the cooling air.

As has been described, for the property paper S whose property is lost when the moisture content X1 is different from the moisture content X2, a cooling parameter allowing the moisture content X1 to become equal or substantially equal to the moisture content X2 is preliminarily found and stored. Then, based on the cooling parameter, the cooling control subunit 702 causes the cooling system 100 to perform the cooling process. Herewith, it is possible to make the moisture content of the opposing part 7*a* of the paper 7 after heating by the heating plate 13 and cooling by the cooling system 100 (X1) equal or substantially equal to the moisture content immediately before the conveyance is stopped (X2), thereby preventing the property of the property paper S from being lost.

Eighth Embodiment

Next is described the eighth embodiment of the present invention. The seventh embodiment relates to the case where only one type of property paper S is used; however, the eighth embodiment relates to the case where multiple types of property paper S are used. In the case of using multiple types of property paper S, for each type of property paper S, a cooling parameter for moisture content at which the type of property paper S does not lose its property (hereinafter, referred to as "proper moisture content") is measured. Then, correspondence information which associates the respective types of property paper S and their measured cooling parameters is prestored in the main storage unit 312 or the like. FIG. 10 shows an example of the correspondence information. In this example, the correspondence information includes two cooling parameters, i.e., cooling temperature C and wind speed V; however, it is sufficient if at least one of the two parameters is included.

In the case of FIG. 10, when the type of property paper is $S_1$, for example, the proper moisture content is $W_1$, the cooling temperature is $C_1$, and the wind speed is $V_1$. That is, the cooling control subunit 702 controls the cooling system 100 in such a manner that the cooling temperature and wind speed become $C_1$ and $V_1$, respectively.

Then, a paper type determining subunit 708 of the control unit 206 determines the type of property paper S to be used for printing. There are various methods for determining the type of property paper S to be used; however, for example, the user may input the paper type using the input unit 317 or the display unit 318 (see FIG. 1). For example, if the type of property paper S is adhesive press-fitted paper, the user inputs information indicating that the paper type is adhesive press-fitted paper using the input unit 317. Alternatively, softkeys for allowing the user to select the paper type may be electrically displayed on the display unit 318. The user presses a corresponding softkey to input the paper type. Then, the paper type determining subunit 708 obtains the paper type input from the input unit 317 or the display unit 318.

In another method, for example, a paper type determining sensor is provided with the paper hopper 11 (see FIG. 2) to determine the paper type, and the paper type determining subunit 708 obtains the paper type using a sensor output from the paper type determining sensor. For example, a paper type identification pattern for allowing identification of a paper type is preliminarily added to each paper. Then, the paper type determining sensor reads the paper type identification pattern and outputs a sensor output.

According to the eighth embodiment of the present invention, it is possible to make the moisture content X1 be equal or substantially equal to the moisture content X2 even when multiple types of property paper S are used, thereby preventing properties of the property paper S from being lost after heating by the heating plate 13 and cooling by the cooling system 100.

According to the seventh and eighth embodiments of the present invention, the opposing part 7*a* is cooled in such a manner as to make the moisture content X1 be equal or substantially equal to the moisture content X2; however, the opposing part 7*a* may be cooled based on the cooling parameter in such a manner as to make the moisture content X1 be equal to the proper moisture content.

Ninth Embodiment

Next is described the ninth embodiment of the present invention. The image forming apparatus 1 including the fixing device 12 according to the ninth embodiment has a detecting unit 610 for detecting the surface temperature of the paper (recording medium) 7. As shown in FIG. 5, the detecting unit 610 is provided, for example, inside the ambient air blowing members 502. For the detecting unit 610, an infrared temperature sensor, for example, is used.

In addition, a proper temperature range D of the paper surface is determined in advance. The temperature range D is the ambient temperature±5° C., for example. The cooling control subunit 702 controls the cooling system 100 in such a manner that the temperature of the paper surface falls in the temperature range D. The temperature range D is prestored in the storage system.

In the case when the surface temperature of the paper 7 is within the temperature range D, the cooling system 100 does not have to cool the paper 7, and the cooling control subunit 702 therefore stops the cooling process by the cooling system 100. On the other hand, when the surface temperature of the paper 7 is beyond or almost beyond the temperature range D, the cooling control subunit 702 causes the cooling system 100 to cool the paper 7.

Thus, according to the ninth embodiment of the present invention, the proper temperature range D for the paper surface is determined in advance, and the cooling control subunit 702 stops the cooling process by the cooling system 100 when the surface temperature of the paper 7 is within the range of the temperature range D. Herewith, it is possible to reduce the cooling cost. On the other hand, when the surface temperature of the paper 7 is beyond or almost beyond the temperature range D, the cooling control subunit 702 causes the cooling system 100 to cool the paper 7. Herewith, it is possible to properly cool the overly heated paper 7.

Tenth Embodiment

In the seventh and eighth embodiments of the present invention, the descriptions are given of the property paper S. The tenth embodiment describes the case where the property paper S is adhesive press-fitted paper. In the following description, the property paper S is referred to as the "adhesive press-fitted paper 7". Here, the adhesive press-fitted paper 7 is paper in which a natural rubber-based sticking agent has been applied on the surface of water proof paper. An example of such is a double postcard. If the adhesive press-fitted paper 7 is stopped over the heating plate 13, moisture in the adhesive press-fitted paper 7 is evaporated, which leads to a decrease in the adhesive strength of the sticking agent. As a result of repeated experiments, it was found that the press-fit strength of the adhesive press-fitted paper 7 is appropriate when the moisture content is 4%, or substantially 4%. In general, the amount of saturated vapor changes due to the temperature of the air over the surface of the adhesive press-fitted paper 7. Therefore, the amount of saturated vapor on the surface of the adhesive press-fitted paper 7 is reduced by cooling the air over the surface of the adhesive press-fitted paper 7 using the cooling system 100. If the amount of saturated vapor over the surface of the adhesive press-fitted paper 7 is reduced, the amount of moisture evaporated from the adhesive press-fitted paper is also reduced.

Here, the cooling system 100 cools the opposing part 7*a* in such a manner as to make the moisture content X1 equal or substantially be equal to the moisture content X2. The method of using the cooling parameter explained in the seventh and eighth embodiments may be used to cool the opposing part 7*a*. Herewith, it is possible to allow the adhesive press-fitted paper 7 to maintain its adequate adhesive strength.

Figure 6:
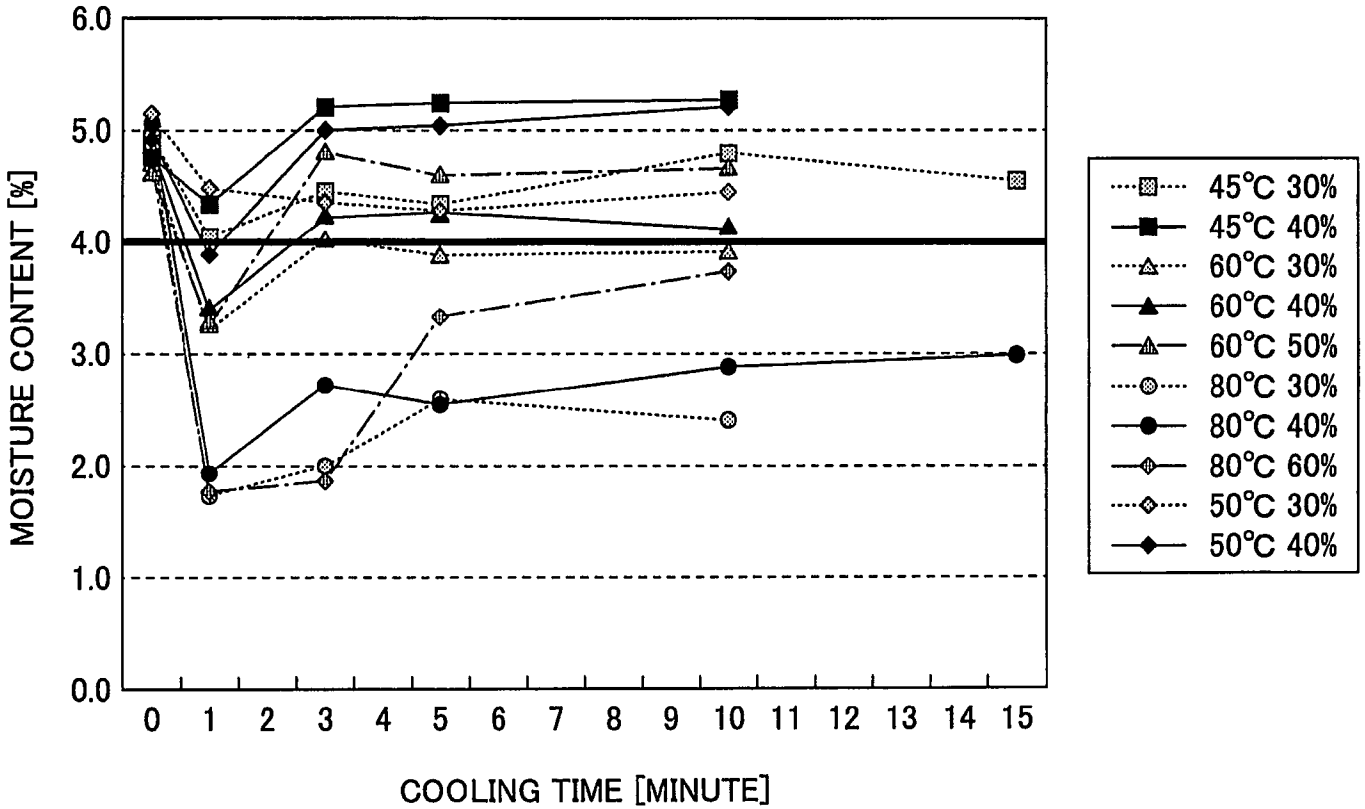
FIG. 6 shows experimental results according to a tenth embodiment of the present invention.

Experiments were conducted to determine temperature and humidity of the inside of the image forming apparatus 1, which temperature and humidity allow the adhesive press-fitted paper 7 to have a moisture content of substantially 4%. A cooling parameter can be obtained by the experiments. FIG. 6 shows a relationship of the moisture content of the adhesive press-fitted paper 7, which is formed by applying a natural rubber-based sticking agent on the surface of water proof paper, with the ambient temperature and humidity of the inside of the image forming apparatus 1. Here, the heating temperature of the heating plate 13 is 90° C.

In FIG. 6, the vertical axis shows the moisture content of the adhesive press-fitted paper 7 and the horizontal axis shows the cooling time. The cooling time is time measured from the start of the cooling process by the cooling system 100. A dotted line with squares, for example, is the case in which the temperature and humidity of the inside of the image forming apparatus 1 were 45° C. and 30%, respectively. In the following, the solid line with squares in FIG. 6, for example, is expressed as "Line (square, solid)".

For example, if the cooling time is one minute, a moisture content close to 4% is obtained when the temperature and humidity are 45° C. and 30%, respectively, as indicated by Line (square, dotted). If the cooling time is ten minutes, a moisture content close to 4% is obtained when the temperature and humidity are 60° C. and 30%, respectively, as indicated by Line (triangle, solid), and also when the temperature and humidity are 60° C. and 40%, respectively, as indicated by Line (triangle, dotted).

More particularly, the higher the ambient temperature around the adhesive press-fitted paper 7, the higher the amount of saturated vapor, and therefore, the amount of moisture evaporated from the adhesive press-fitted paper 7 increases when the ambient temperature around the adhesive press-fitted paper 7 is higher. This has also been proved by the experiments with the ambient temperature between 45° C. and 80° C., as shown in FIG. 6 in which the moisture content decreases with higher ambient temperature. In addition, it has also been found from the experimental results that moisture is evaporated drastically in a high temperature environment of 80° C. even if a high amount of moisture is present in the air (a humidity of 60%), and then, moisture comes back to the adhesive press-fitted paper 7 slowly over 10 minutes or so. This means that, even if moisture is provided with the adhesive press-fitted paper 7 having been stopped, it takes time for moisture to penetrate into the adhesive press-fitted paper 7, which interferes with a restart of printing.

According to the experimental results, it has been found that lowering the temperature of the air on the paper surface is an efficient way to reduce the amount of decrease in moisture content. Additionally, once moisture is stripped away from the adhesive press-fitted paper 7, an environment with simply high humidity is not sufficient to maintain the moisture content of the adhesive press-fitted paper 7 at 4%. Therefore, the moisture content of the adhesive press-fitted paper 7 should be maintained by the cooling process.

Furthermore, by measuring in advance the proper moisture content for each type of the adhesive press-fitted paper 7, the temperature and humidity of the inside of the image forming apparatus 1, and the cooling time, as in the experiments illustrated in FIG. 6, it is possible to obtain the cooling parameter (at least one of the cooling temperature and the wind speed) described in the seventh and eighth embodiments and the correspondence information (see FIG. 10). Based on the correspondence information, the cooling system 100 cools the adhesive press-fitted paper 7 using the cooling parameter, and herewith it is possible to further prevent decrease in sticking strength of the adhesive press-fitted paper 7.

With the fixing device and the image forming apparatus according to embodiments of the present invention, it is possible to properly prevent paper damage/contraction and the like even when paper stops on the heating plate for more than a fixed period of time.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. A fixing device comprising:

a conveying unit configured to convey a recording medium;

a conveyance stopping unit configured to stop conveyance of the recording medium;

a heating unit having a heating plane and configured to heat a part of the recording medium, which part is laid over the heating plane; and a cooling unit configured to cool the part of the recording medium, whose conveyance has been stopped, by applying cooling air to the part of the recording medium from above the recording medium.

2. The fixing device as claimed in claim 1, wherein the cooling unit includes, an intake unit configured to take in ambient air and blow out the ambient air, and an ambient air blowing unit configured to cool the part of the recording medium by applying the ambient air blown out of the intake unit to the part of the recording medium as the cooling air.

3. The fixing device as claimed in claim 2, wherein plural of the intake units are aligned in a width direction of the recording medium, and the cooling air is applied to the part of the recording medium using the ambient air blowing unit and a number of the intake units corresponding to a width of the recording medium.

4. The fixing device as claimed in claim 2, wherein plural of the ambient air blowing units are aligned, and partition plates are provided between adjacent ambient air blowing units to separate the adjacent ambient air blowing units.

5. The fixing device as claimed in claim 3, wherein plural of the ambient air blowing units are aligned, and partition plates are provided between adjacent ambient air blowing units to separate the adjacent ambient air blowing units.

6. The fixing device as claimed in claim 2, wherein the cooling unit includes a cooling air conveying unit configured to be stretchable and convey the ambient air blown out of the intake unit to the ambient air blowing unit.

7. The fixing device as claimed in claim 5, wherein the plural intake units correspond one-to-one with the plural ambient air blowing units, and the cooling unit includes a cooling air conveying unit configured to be stretchable and convey the ambient air blown out of a number of the intake units to ambient air blowing units corresponding to the number of the intake units.

8. The fixing device as claimed in claim 1, wherein the cooling unit cools the part of the recording medium in such a manner as to maintain moisture content of the part of the recording medium equal, or substantially equal, to the moisture content of the part of the recording medium immediately before the conveyance is stopped.

9. The fixing device as claimed in claim 1, wherein the cooling unit cools the part of the recording medium based on a cooling parameter for moisture content of the part of the recording medium, at which moisture content a property of the recording medium is not lost.

10. The fixing device as claimed in claim 1, further comprising a storage unit prestoring correspondence information in which one or more types of recording media are associated with respective cooling parameters for moisture content of the recording media, at which moisture content a property of the associated recording medium is not lost, wherein the cooling unit cools the part of the recording medium based on the cooling parameter associated with the type of the recording medium whose conveyance has been stopped.

11. The fixing device as claimed in claim 9, wherein the cooling parameter is at least one of temperature and wind speed of the cooling air.

12. The fixing device as claimed in claim 10, wherein the cooling parameter is at least one of temperature and wind speed of the cooling air.

13. The fixing device as claimed in claim 8, wherein in a case where the recording medium is adhesive press-fitted paper formed by applying a natural rubber-sticking agent to water proof paper, the moisture content is 4%, or substantially 4%.

14. The fixing device as claimed in claim 1, wherein in a case where a distance between the part of the recording medium and an outlet from which the cooling air of the cooling unit is discharged is between 10 and 30 mm, the cooling air has a wind speed of 10 m/s, or substantially 10 m/s.

15. The fixing device as claimed in claim 1, wherein the part of the recording medium is a heated plane, and in a case where a distance between the heated plane and an outlet from which the cooling air of the cooling unit is discharged is between 10 and 30 mm and the cooling air has a wind speed of 10 m/s, or substantially 10 m/s, an angle between a travel direction of the cooling air and the heated plane is 60° or more and 120° or less.

16. The fixing device as claimed in claim 1, wherein the part of the recording medium is a heated plane, and a travel direction of the cooling air is perpendicular, or substantially perpendicular, to the heated plane.

17. An image forming apparatus comprising:

a fixing device which includes, a conveying unit configured to convey a recording medium, a conveyance stopping unit configured to stop conveyance of the recording medium, a heating unit having a heating plane and configured to heat a part of the recording medium laid over the heating plane, and a cooling unit configured to cool the part of the recording medium, whose conveyance has been stopped, by applying cooling air to the part of the recording medium from above the recording medium; and an image forming unit configured to form an image on the recording medium.

18. The image forming apparatus as claimed in claim 17, wherein at a start of image formation by the image forming unit, cooling by the cooling unit is stopped.

19. The image forming apparatus as claimed in claim 17, further comprising: a detecting unit configured to detect a surface temperature of the recording medium; and a cooling control unit configured to control the cooling unit in such a manner that the surface temperature falls within a predetermined range.

20. The image forming apparatus as claimed in claim 18, further comprising: a detecting unit configured to detect a surface temperature of the recording medium; and a cooling control unit configured to control the cooling unit in such a manner that the surface temperature falls within a predetermined range.

* * * * *